United States Patent [19]

Sommer

[11] 4,120,493

[45] Oct. 17, 1978

[54] COLLAPSIBLE ROCKING TOY

[75] Inventor: Irving Sommer, Commack, N.Y.

[73] Assignee: Toy Professionals Unlimited, Inc., Commack, N.Y.

[21] Appl. No.: 767,195

[22] Filed: Feb. 9, 1977

[51] Int. Cl.[2] ..... A63G 17/00

[52] U.S. Cl. ..... 272/52; 46/1 L

[58] Field of Search ..... 272/52, 52.5, 53.1, 272/53.2, 56; 46/157, 1 L; 280/87.05; 297/131, 258, 770, 271, 272

[56] References Cited

U.S. PATENT DOCUMENTS

| | | | |
|---|---|---|---|
| 554,410 | 2/1896 | Bailey | 46/157 |
| 2,844,188 | 7/1958 | Thompson | 272/52 UX |
| 2,998,979 | 9/1961 | Sandell | 280/87.05 |

FOREIGN PATENT DOCUMENTS

| | | | |
|---|---|---|---|
| 2,205,101 | 8/1973 | Fed. Rep. of Germany | 272/52 |
| 267,022 | 3/1927 | United Kingdom | 46/157 |
| 563,149 | 8/1944 | United Kingdom | 46/157 |
| 1,260,127 | 1/1972 | United Kingdom | 272/53.2 |

*Primary Examiner*—Anton O. Oechsle

*Attorney, Agent, or Firm*—Blum, Moscovitz, Friedman & Kaplan

[57] ABSTRACT

A collapsible rocking toy is provided having a body portion constructed from a single blank of material folded in the shape of an inverted V and having arcuate lower ends. A base panel secured to the lower ends of the body panel is foldable upwardly along its centerline so that when the body portion is folded, the base panel will foldably nest within the body panel. The body portion includes an integral seat formed by score lines and has means for releasably securing a headpiece, tail-piece and strap.

16 Claims, 12 Drawing Figures

FIG. 11
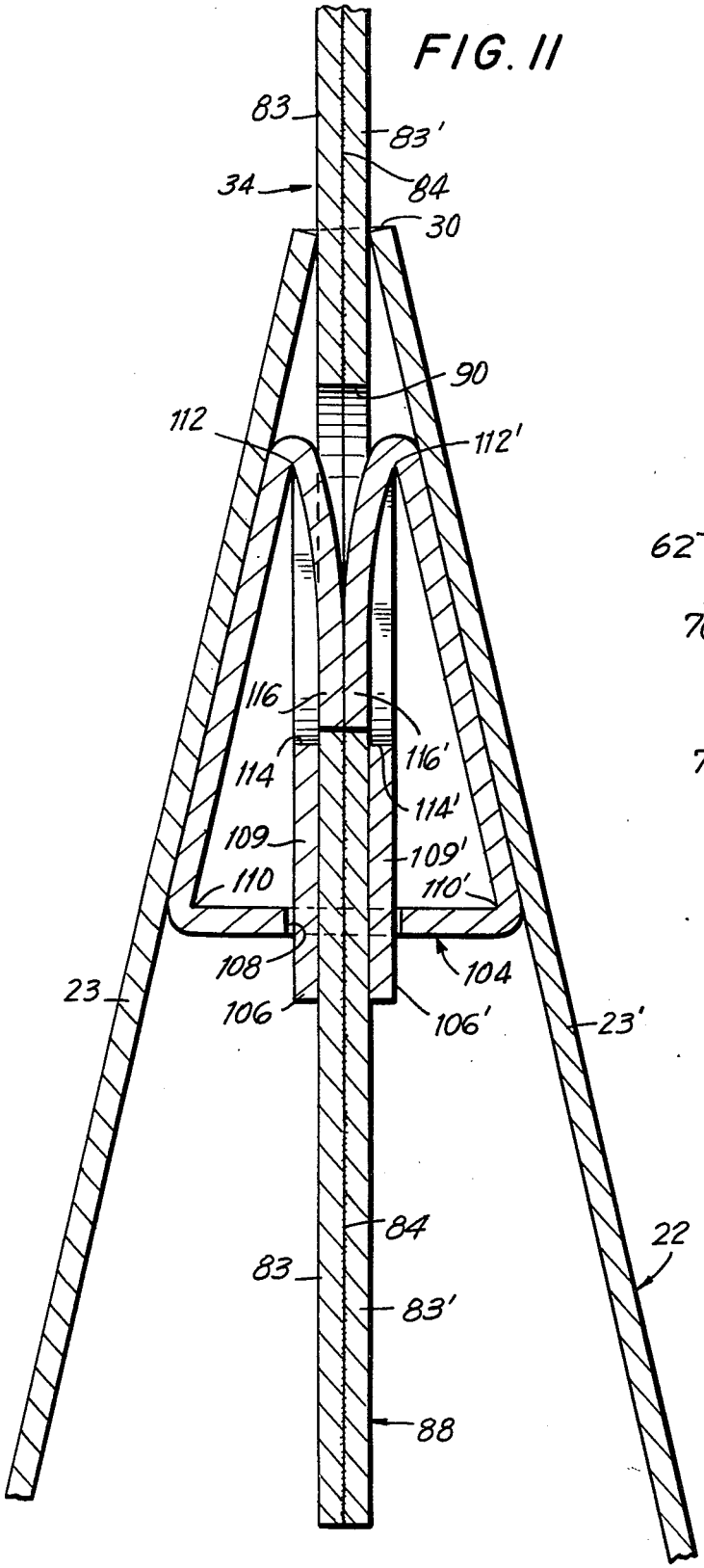
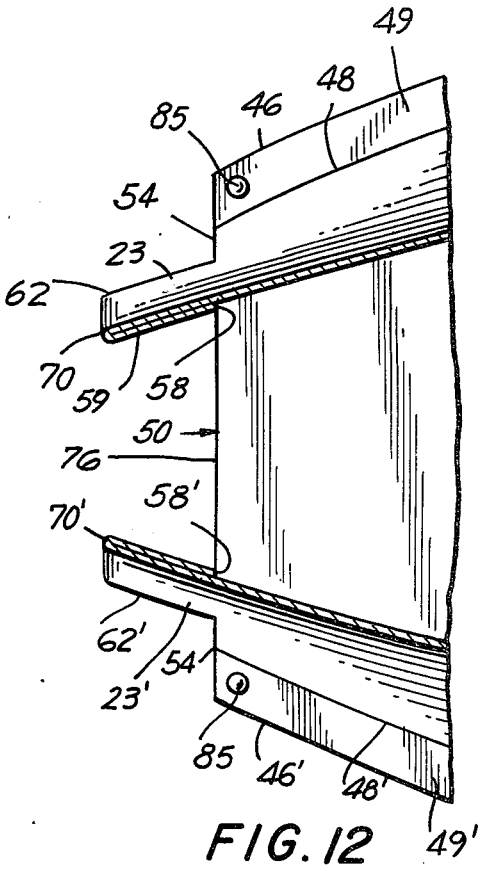
FIG. 12

COLLAPSIBLE ROCKING TOY

BACKGROUND OF THE INVENTION

This invention relates generally to an improved rocking toy and especially to collapsible rocking toys. While various collapsible rocking toys have been known in the art, such devices have generally required extremely rigid material for construction. Such material tends to be relatively expensive and relatively heavy for the use intended. Additionally, known collapsible rocking toy constructions generally required attachment of a separate seat member. Such constructions also tended to require a large amount of steps in order to complete assembly. Furthermore, such constructions generally simulated only one animal or were so basic as to simulate no animal at all. The instant invention provides a simple and lightweight construction utilizing fairly inexpensive materials yet providing for an extremely sturdy yet collapsible rocking toy.

SUMMARY OF THE INVENTION

Generally speaking, in accordance with the invention, a collapsible rocking toy is provided having a body portion constructed from a single blank of material folded along a longitudinal score line in the shape of an inverted V and having arcuate lower ends. A base panel secured to the lower ends of the body panel is foldable along its centerline so that when the body portion is folded, for coordinate folding with the body portion for the collapse of the toy, the base panel may upwardly nest within the body panel. The body portion includes an integral depressed seat region formed by seat score lines on opposed sides of said longitudinal score line and has means for releasably securing a headpiece, tail piece and/or a strap.

Accordingly, it is an object of this invention to provide a rocking toy that is collapsible.

Another object of this invention it so provide a rocking toy that is capable of being readily user assembled without tools.

A further object of this invention is to provide a rocking toy that is inexpensive to manufacture and easy to assemble.

Still a further object of this invention is to provide an improved rocking toy that is constructed from lightweight, inexpensive, yet durable material.

Still another object of the invention is to provide a rocking toy having a standard body capable of depicting a plurality of selected characters to enhance its play value by selection of artwork on said body and head and/or tail portions.

Still other objects and advantages of the invention will in part be obvious and will in part be apparent from the specification and drawings.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 9, 10, 11 and 12 are fragmentary sectional views taken along lines 9—9, 10—10, 11—11, and 12—12, respectively, of FIG. 6.

DESCRIPTION OF THE PREFERRED EMBODIMENT

Figure 1:
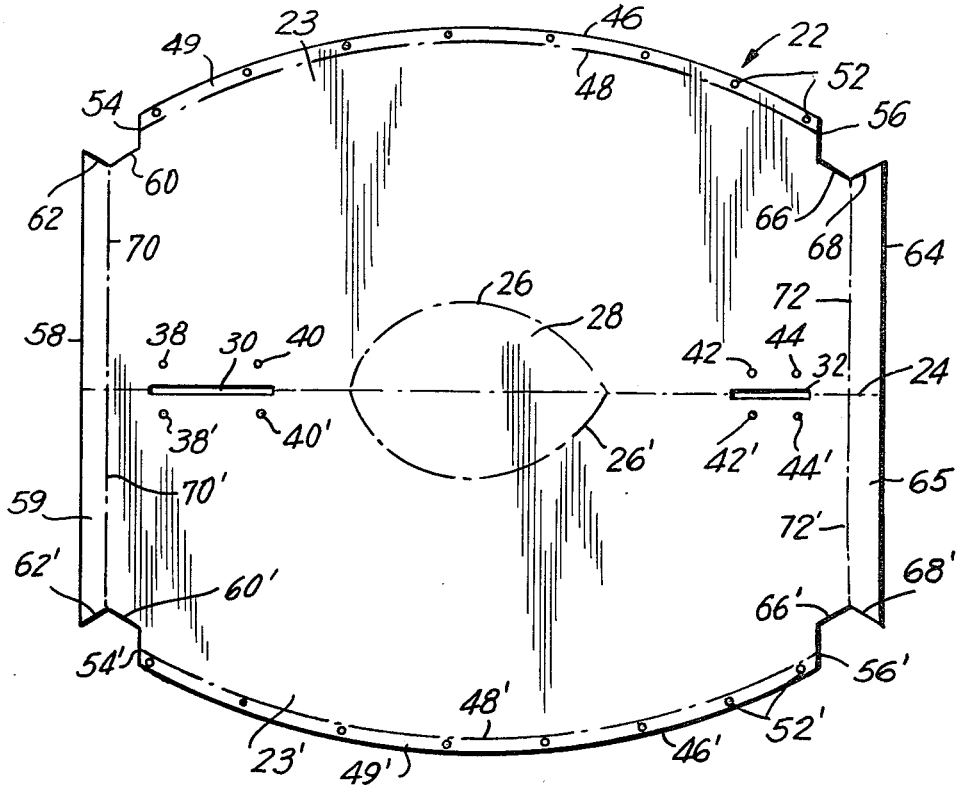
FIG. 1 is a top plan view of a body blank of a collapsible rocking toy constructed in accordance with the instant invention.

The collapsible rocking toy 20 in accordance with the invention has a body portion 21 formed from a body blank 22 and a base blank 50. As more particularly shown in FIG. 1, body blank 20 is formed of a pair of side panels 23, 23' symmetrical about a longitudinal score line 24. At the center of body blank 22 a pair of semi-eliptical score lines 26, 26' extend symmetrically from longitudinal score line 24 and define seat portion 28 of rocking toy 20. A forward slot 30 is also located on score line 24 along with a rearward slot 32. Slots 30 and 32 allow the insertion of headpiece 34 and tailpiece 36, respectively, as will hereinafter be described in greater detail. Two pairs of openings 38, 38' and 40, 40' are provided on blank 22 proximate to slot 30. Corresponding pairs of openings 42, 42' and 44, 44' are provided proximate to slot 32. The two apertures of each of said pairs of apertures are aligned on opposed sides of longitudinal score line 24 at points positioned inwardly of the ends of the associated slots 30, 32 for registration when body blank 22 is folded along said longitudinal score line.

The side edges 46, 46' of body blank 22 are arcuate in shape to provide the curved lower ends needed for rocking when body blank 22 is folded along score line 24 to define an inverted V shape. Concentric with arcuate edges 46, 46' are score lines 48, 48' defining flaps 49, 49' which may be bent outwardly for attachment to a base blank 50. A series of openings 52 are provided in flaps 49, 49' for the insertion of fasteners for effecting such attachment. Edges 46, 46' are bounded by forward edges 54, 54' and rearward edges 56, 56' which extend perpendicular to score line 24. Edges 54, 54' are joined to forward edge 58 by inwardly extending edges 60, 60' and outwardly extending edges 62, 62' respectively. Correspondingly, rearward edges 56, 56' are joined to rearward edge 64 by means of inwardly extending edges 66, 66' and outwardly extending edges 68, 68', respectively. A score line 70 extends from the intersection of edges 60, 62 to the intersection of edges 60', 62' and a score line 72 extends from the intersection of edges 66, 68 to the intersection of edges 66', 68'. A flap 59 defined between forward edge 58 and score line 70 is foldable along score line 70 so that edges 62, 62' align with edges 60, 60'. A flap 65 defined between rearward edge 64 and score line 72 is foldable along score line 72 so that edges 68, 68' align with edges 66, 66'. After folding over, flaps 59 and 65 will be secured by any suitable means such as fasteners or adhesives. When flaps 59 and 65 are so secured in the folded position, as more particularly shown in FIG. 12, considerable structural rigidity is imparted to body blank 22 allowing it to easily carry the weight of a child sitting in seat portion 28.

Figure 2:
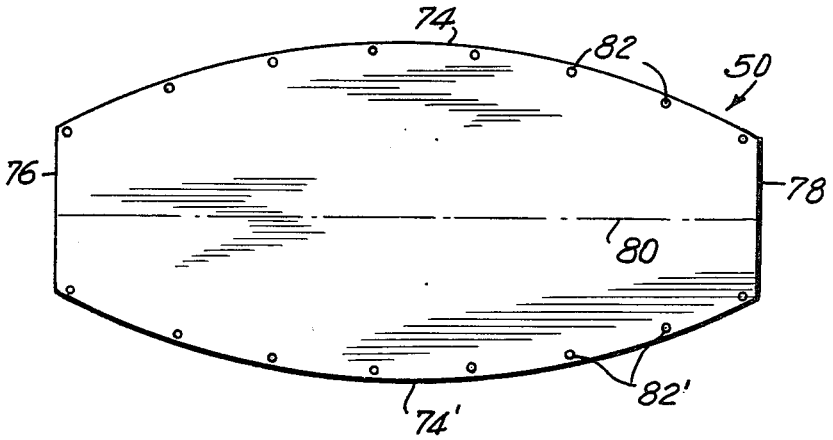
FIG. 2 is a top plan view of the base blank of the rocking toy of the instant invention.
Figure 3:
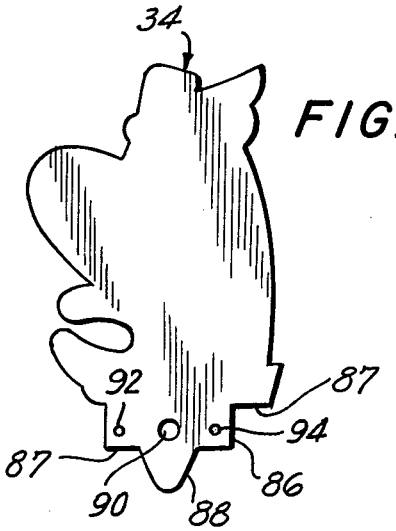
FIG. 3 is a side elevational view of one embodiment of the headpiece of the rocking toy of the instant invention.

Base blank 50 is illustrated in FIG. 2 and includes a pair of arcuate side edges 74, 74' which correspond in arc to edges 46, 46' of blank 22. Base blank 50 has a forward edge 76 and a rearward edge 78 and is foldable along longitudinal score line 80 located along the longitudinal centerline of base blank 50. A series of openings 82, 82' adjacent to edges 74, 74' correspond in location to openings 52, 52' of blank 22.

Blanks 22 and 50 are assembled as follows: Body blank 22 is folded along longitudinal score line 24 forming an inverted V shaped configuration. Flaps 49, 49' are folded outwardly along score lines 48, 48' so as to remain parallel with base blank 50. Base blank 50 is joined to blank 22 by means of rivets 85 extending through openings 52, 52' in body blank 22 and openings 82, 82' in base blank 50. When base blank 50 is joined to body blank 22 it follows the generally arcuate configuration of edges 46, 46' in order to permit a rocking motion of collapsible rocking toy 20.

Figure 7:
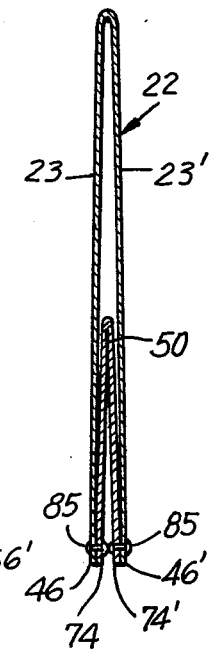
FIG. 7 is an edge view of the folded body blank with the folded base blank nested therein in shipping position.

When base blank 50 is joined to body blank 22, both blanks remain foldable about score lines 24 and 80. Body blank 22 is foldable downwardly about score line 24 and blank 50 is foldable upwardly along score line 80. Thus, for shipment, as shown in FIG. 7, folded blank 50 will nest within folded blank 22 and lie essentially flat. This nesting arrangement permits a large number of collapsible rocking toys to be stored and shipped in a very small amount of space.

Blanks 22 and 50, as well as headpiece 34 and tailpiece 36, should be formed from lightweight, foldable yet strong material which is easily die cutable. The ideal material for such application is corrugated cardboard.

Headpiece 34 is composed of two identical blanks 83, 83' joined by adhesive 84 (FIG. 11). Headpiece 34 is formed in the shape of an animal or cartoon character and also carries artwork further depicting the animal or character. The outer surfaces of side panels 23, 23' of body blank 22 may likewise be formed with artwork thereon to create the image of an animal or cartoon character in cooperation with headpiece 34 and tailpiece 36.

A tab 86 extending from the bottom of headpiece 34 is dimensioned to be received in slot 30 of body blank 22. A further triangular tab 88 extends downwardly from tab 86. Tab 86 has a central large opening 90 and a pair of smaller openings 92 and 94 on either side. Tab 86 is narrower than the adjacent region of headpiece 34 to define edges 87 which rest on longitudinal score line 24 when tab 86 is inserted in slot 30 to limit the downward displacement of said headpiece. Opening 92 and 94 are spaced from each other and from the line defined by edges 87 to align with openings 38, 38' and 40, 40' respectively when tab 86 is inserted in slot 30. Tailpiece 36 is optional depending on the character or animal depicted. Tailpiece 36 is identical in construction to that of headpiece 34 being constructed from a pair of identical blanks 96, 96' joined adhesively and having a downwardly extending rectangular tab 98 having three openings (not shown) identical to those in tab 86 of headpiece 34 and a triangular tab 100. Tailpiece 36 is adapted for insertion in slot 32 with two of the openings in tab 98 aligning with openings 42, 42' and 44, 44', respectively in body blank 22.

Figure 4:
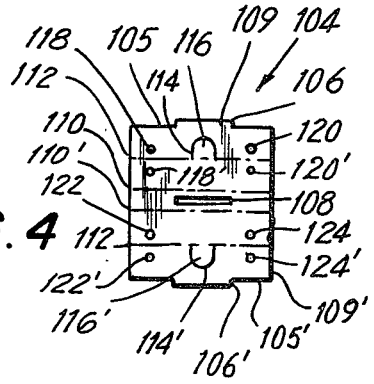
FIG. 4 is a top plan view of the blank used to form a reinforcing member of the rocking toy of the instant invention.
Figure 5:
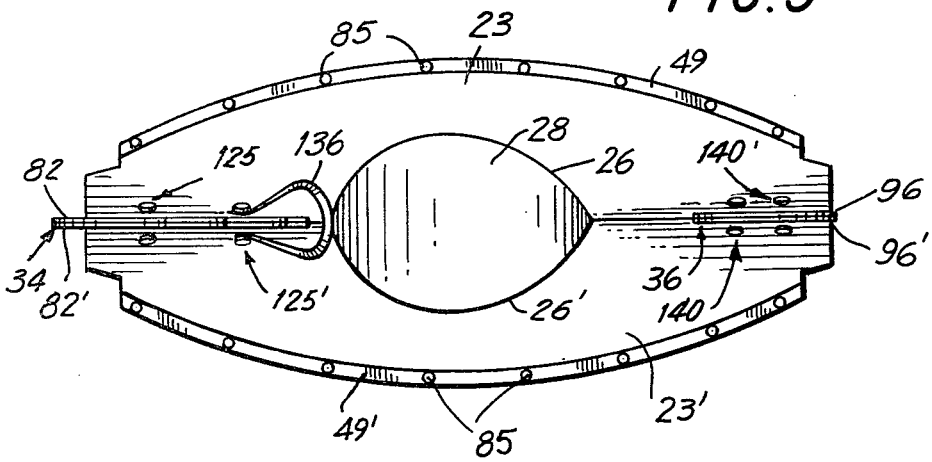
FIG. 5 is a top plan view of the foldable rocking toy constructed in accordance with the instant invention.
Figure 6:
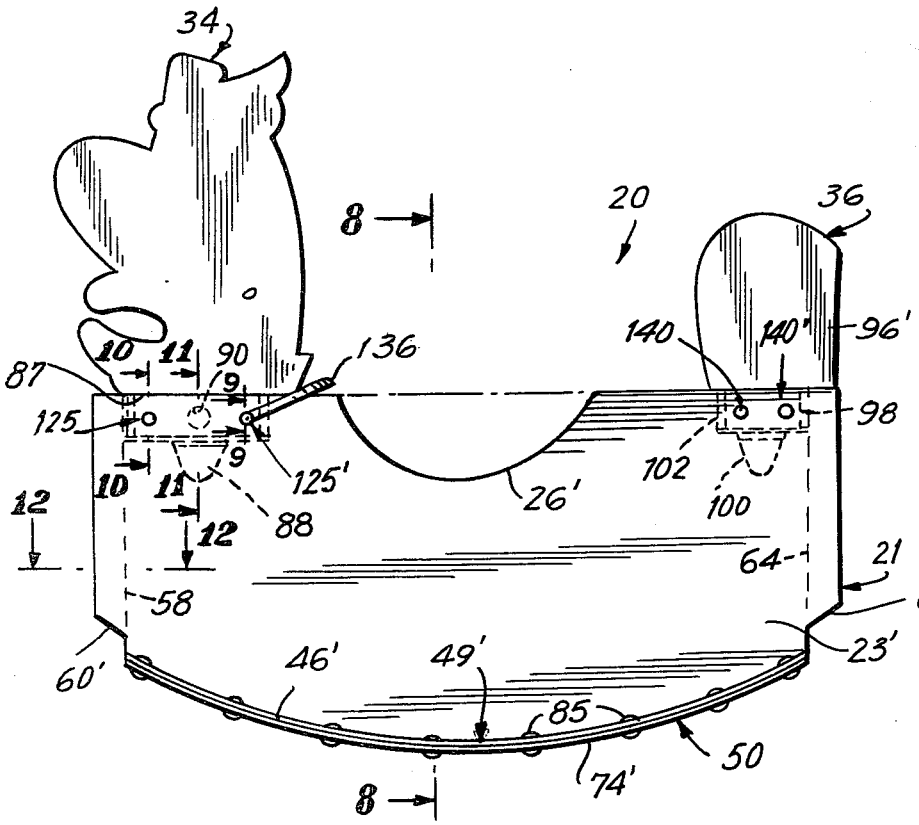
FIG. 6 is a side elevational view of the assembled foldable rocking toy in accordance with the invention.

Headpiece 34 is located and locked into position with respect to body blank 22 by means of reinforcing blank 104 more particularly shown in FIG. 4. Reinforcing blank 104 is generally rectangular in configuration and has a pair of relatively short tabs 106, 106' extending from its upper and lower edges 105, 105', respectively. Blank 104 has a centrally located slot 108 which is dimensioned to receive locking tabs 106, 106' and tab 88 of headpiece 34. Slot 108 is located between a pair of inner spaced score lines 110, 110' and a pair of outer spaced score lines 112, 112', which score lines all extend substantially parallel to edges 105, 105' and slot 108. A pair of U-shaped slits 114, 114' extend outwardly from the center of outer score lines 112, 112', respectively and define locking tabs 116, 116'. A first pair of openings 118, 118', a second pair of openings 120, 120', a third pair of openings 122, 122' and a further pair of openings 124, 124' are formed in reinforcing blank 104. Pair of openings 118, 118' and 120, 120' are positioned on opposed sides of outer score line 112 which pairs of openings 122, 122' and 124, 124' are positioned on opposed sides of outer score line 112'. Each pair of openings are equally spaced from their respective outer score line and aligned therewith, the spacing between pairs of openings 118, 118' and 120, 120' are between pairs of openings 122, 122' and 124, 124' substantially equals the spacing between pairs of openings 38, 38' and 40, 40' of body blank 22.

Figure 10:
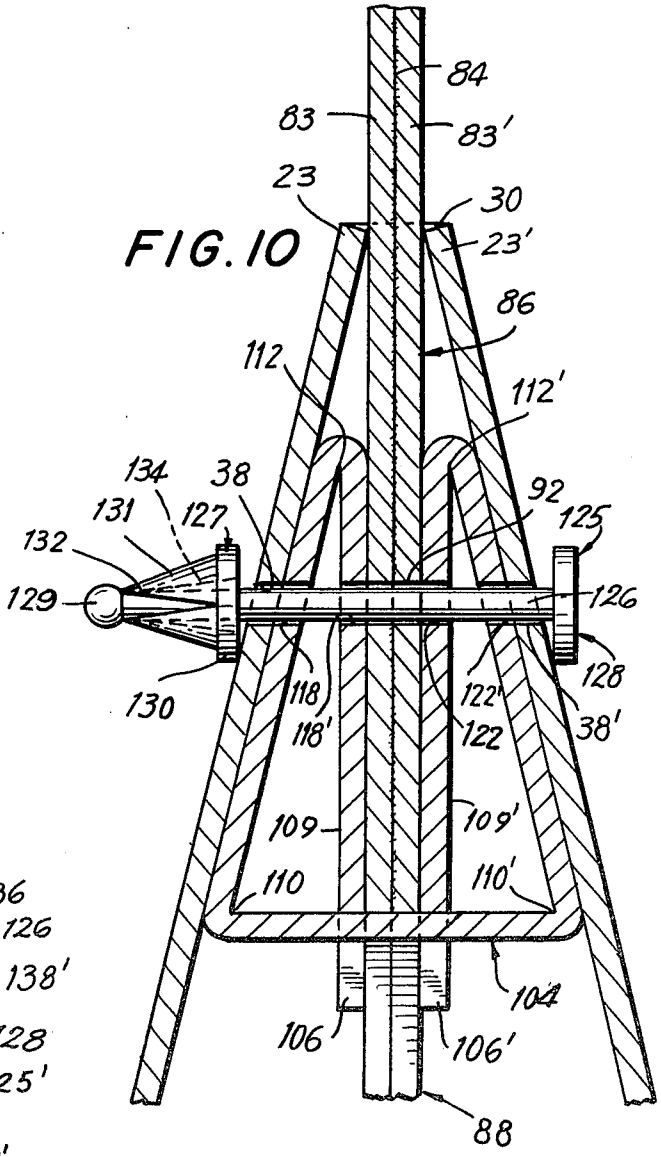

A reinforcing member 102 is constructed from reinforcing blank 104 by a first fold upwardly along score lines 110, 110', a second fold downwardly along score lines 112, 112' and the insertion of tabs 106, 106' into slot 108 as shown in FIGS. 10 and 11. When folded in this manner, openings 122', 122 and openings 118', 118 will be aligned. Similarly, openings 124', 124 and 120', 120 will also be aligned. Thus, when base blank 50 and body blank 22 are in the open, unfolded position folded reinforcing blank 104 may be inserted and positioned within folded body blank 22 so that its slot 108 aligns with slot 30 of body blank 22. Aligning slot 108 with slot 30 will bring opening 38, 38' in alignment with opening 122, 122', and 118, 118'. Similarly, openings 40, 40' of body blank 22 will be aligned with the openings 124, 124' and 120, 120' of reinforcing blank 104. Tab 86 of headpiece 34 is then inserted in slot 30 of body blank 22 as folded reinforcing blank 104 is held in place. Tab 86 will pass between the panels 109, 109' defined by outer score lines 112, 112' and edges 105, 105' of said reinforcing blank. When tab 86 is inserted into slot 30, tab 88 will be inserted into slot 108. Such insertion and the centering of reinforcing blank 104 is simplified by the triangular shape of tab 88. Headpiece 34 is locked to reinforcing blank 104 by displacing locking tabs 116, 116' together so as to engage opening 90 in tab 86 as headpiece 34 passes between the panels 109, 109'.

After the various openings are aligned, as noted above, headpiece 34, reinforcing blank 104 and body blank 22 may be locked together by means of locking fasteners 125 (FIG. 10). Locking fasteners 125 are comprised of two parts; a rod 126 and a cap 127. Rod 126 has a circular disc 128 at one end and an enlarged ball 129 at the other. Cap 127 has a cylindrical inner portion 130 and a conical outer portion 131 which is divided by V-shaped slots 132. A tapered axial bore 134 extends from the outer edge of cylindrical portion 130 to the tip of conical portion 131, said bore tapering from a widest point at the outer edge of cylindrical portion 130. Bore 134 permits the insertion of ball tip 129 through cap 127 to spread apart each half of conical portion 131, due to the flexibility imparted to it by slots 132. After ball tip 129 passes the end of conical portion 131, each half will close upon rod 126 and firmly lock cap 127 to rod 126, ball tip 129 preventing removal of said rod. Thus, the insertion of rod 126 into openings 38, 38' and the respective openings in reinforcing blank 104 and tab 86 of headpiece 34, and the mounting of cap 127, will firmly lock these respective members together.

Figure 9:
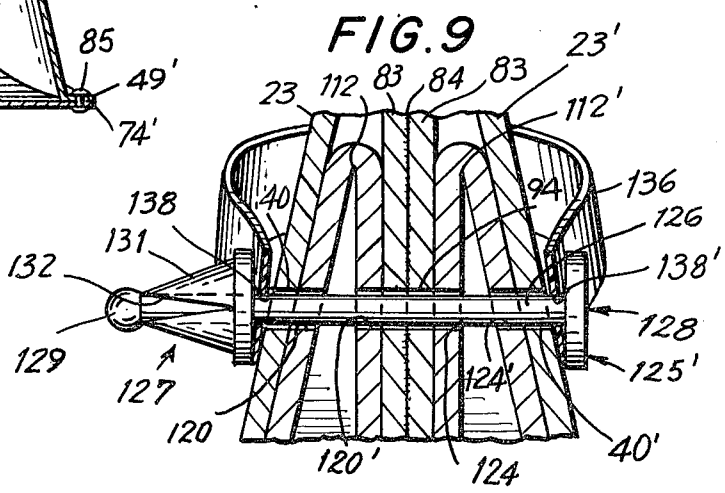

As more particularly shown in FIG. 9, a second locking fastener 125' is inserted into the openings 40, 40' and the openings aligned therewith in reinforcing blank 104 and headpiece 34. A strap 136 having openings 138, 138' in the ends thereof is mounted on said second locking fastener 125' by passing the rod of said second fastener through openings 38, 38' with the ends of strap 136 on the outside of body blank 22.

The securing of optional tailpiece 36 in slot 32 is in all respects identical to the securing of headpiece 34 utilizing a second reinforcing blank 102 and two locking fasteners 140, 140'.

Complete assembly of collapsible rocking toy 20 from shipped state to ready for use is as follows. Body blank 22 and base blank 50 would be shipped, as shown in FIG. 7, secured, folded and nested together. The user then folds base blank 50 downwardly to form an arcuate base and thus opening body blank 22. Hand pressure in the area defined by seat score lines 26, 26' will cause this area to depress into seat portion 28, which also serves to keep the base panels and body panels open. Reinforcing blanks 102 and 104 would be folded, as described above, and inserted under slots 30 and 32. Headpiece 34 and tailpiece 36 may then be inserted through slots 30 and 32, respectively in body blank 22 and thence through the corresponding slot 108 in reinforcing blanks 102, 104. Locking fasteners 125, 125', 140, 140' are then inserted through the various openings to lock said headpiece and tailpiece in place and to mount strap 136. Locking fasteners 125, 125', 140, 140' may be provided with removable caps if desired.

Figure 8:
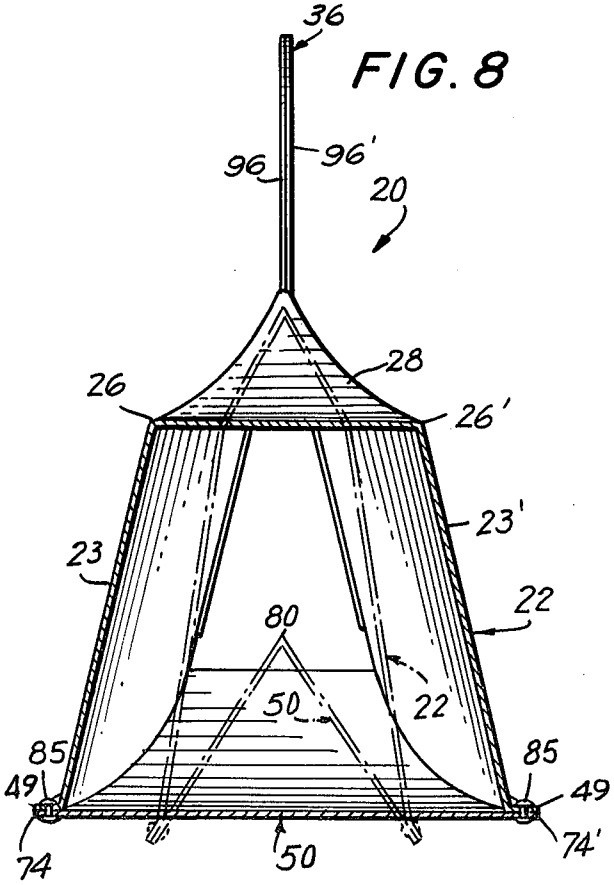
FIG. 8 is a sectional view taken along lines 8—8 of FIG. 6 and of the rocking toy in accordance with the invention in a storage position.

After complete assembly either there is sufficient play between body blank 22 and member 108, or body blank 22 is sufficiently flexible to allow the collapsible rocking toy 20 to be stored in a semi-collapsed condition as shown by the phantom lines in FIG. 8.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A rocking toy comprising, side panel means, said side panel means being pivotally joined at the top thereof along a longitudinally extending line, and each having an arcuate lower end formed with an outwardly folded peripheral flange for rocking thereof, base panel means secured to and between the peripheral flanges of the lower ends of said side panel means, said base panel means being foldable about its longitudinally extending centerline for folding coordinate with the pivoting of said side panel means and seat means mounted to said said panel means.

2. A rocking toy as claimed in claim 1, wherein said seat means are integral with said side panel means.

3. A rocking toy as claimed in claim 1, wherein said side panel means include a forward and rearward edge, at least one of said edges being folded upon itself for additional strength.

4. A rocking toy as claimed in claim 1 having an upstanding member releasably secured to said side panel means.

5. A rocking toy as claimed in claim 1, wherein said side panel means comprises a single body blank of foldable material, said blank having a longitudinal score line along said longitudinally extending line for forming said body blank into an inverted V-shape.

6. A rocking toy as claimed in claim 5, wherein said body blank and said base panel means are both formed from corrugated board.

7. A rocking toy as claimed in claim 5, said seat means including seat score lines surrounding a portion of said longitudinal score line for defining a seat portion therein when the region of said body blank between said seat score lines is depressed toward said arcuate lower end.

8. A rocking toy as claimed in claim 7, further including at least one slot disposed on said longitudinally extending score line for insertion of an upstanding member.

9. A rocking toy as claimed in claim 8, further including reinforcing means for vertically positioning and at least in part supporting said upstanding member, said reinforcing means being mounted between said side panel means below said longitudinal score line.

10. A rocking toy as claimed in claim 9, including at least two of said slots positioned forwardly and rearwardly respectively of said seat means on said longitudinal score line of said body blank and at least one upstanding member mounted in each said slot.

11. A rocking toy as claimed in claim 1, wherein said base panel means is foldable upwardly between said side panel means, so that said base panel means nest within said side panel means when folded.

12. A rocking toy comprising first and second side panel means pivotably joined at the top thereof along a longitudinally extending line and defining at least one slot opening along said line, said side panel means each having an arcuate lower end for rocking thereof; base panel means secured between the respective lower ends of said side panel means, an upstanding member having a lower portion extending through said slot opening into the region intermediate said side panel means; and reinforcing means for vertically positioning and at least in part supporting said upstanding member, said reinforcing means being mounted between said side panel means below said slot opening, said reinforcing means comprising a first panel for extending between said side panel means spaced from said longitudinally extending line and slot opening, said first panel including means for engaging said upstanding member, a second and third panel, said second and third panels extending upwardly from said first panel, said second and third panels at least in part abutting the interior of said side panel means, and a fourth and fifth panel, said fourth and fifth panels extending downwardly from said third and fourth panels, said fourth and fifth panels at least in part abutting said upstanding member for vertical positioning of said upstanding member between said fourth and fifth panels.

13. A rocking toy as claimed in claim 12, wherein said upstanding member includes a downwardly extending tab and said means for engaging said upstanding member in said reinforcing means includes a slot for insertion of said tab of said upstanding member into said slot.

14. A rocking toy as claimed in claim 12, wherein said upstanding member includes an opening therein and at least one of said fourth and fifth panels include a tab for receipt in and engaging said opening of said upstanding member.

15. A rocking toy comprising first and second side panel means pivotably joined at the top thereof along a longitudinally extending line and defining at least one slot opening along said line, said side panel means each having an arcuate lower end for rocking thereof; base panel means secured between the respective lower ends of said side panel means, an upstanding member having a lower portion extending through said slot opening into the region intermediate said side panel means; reinforcing means for vertically positioning and at least in part supporting said upstanding member, said reinforcing means being mounted between said side panel means below said slot opening, said first and second side panel means, reinforcing means and upstanding member being respectively formed with aligned openings, and fastener means for passing through said aligned openings for holding said joined first and second side panel means, reinforcing means and upstanding member together.

16. A rocking toy as claimed in claim 15, wherein said side panel means comprises a single body blank of foldable material, said blank having a longitudinal score line along said longitudinally extending line for forming said body blank into an inverted V-shape, said body blank being formed with said aligned openings positioned in sapced relation to said longitudinal score line on opposed sides thereof.

* * * * *